US009089995B2

(12) United States Patent
Nelson

(10) Patent No.: US 9,089,995 B2
(45) Date of Patent: Jul. 28, 2015

(54) ISOLATOR PLATE ASSEMBLY FOR ROCK BREAKING DEVICE

(76) Inventor: Craig Nelson, Gordon, WI (US)

( * ) Notice: Subject to any disclaimer, the term of this patent is extended or adjusted under 35 U.S.C. 154(b) by 847 days.

(21) Appl. No.: 13/301,424

(22) Filed: Nov. 21, 2011

(65) Prior Publication Data

US 2012/0060816 A1 Mar. 15, 2012

Related U.S. Application Data

(63) Continuation-in-part of application No. 11/873,067, filed on Oct. 16, 2007, now Pat. No. 8,061,439.

(51) Int. Cl.
*B25D 17/24* (2006.01)
*B28D 1/26* (2006.01)

(52) U.S. Cl.
CPC ..... *B28D 1/26* (2013.01)

(58) Field of Classification Search
CPC ..... B25D 17/24
USPC ..... 173/162.1, 210, 128
See application file for complete search history.

(56) References Cited

U.S. PATENT DOCUMENTS

| | | | | | |
|---|---|---|---|---|---|
| 3,944,300 | A | * | 3/1976 | Learmont et al. | 384/29 |
| 4,018,291 | A | | 4/1977 | Anderson | |
| 4,637,475 | A | * | 1/1987 | England et al. | 173/193 |
| 4,724,912 | A | | 2/1988 | Miyazaki et al. | |
| 4,759,412 | A | | 7/1988 | Brazell, II | |
| 4,838,363 | A | | 6/1989 | MacOnochie | |
| 5,088,564 | A | | 2/1992 | Kobayashi | |
| D326,857 | S | | 6/1992 | Ikeda et al. | |
| 5,117,925 | A | | 6/1992 | White | |
| 5,167,396 | A | | 12/1992 | Burba et al. | |
| 5,263,544 | A | | 11/1993 | White | |
| 5,285,858 | A | | 2/1994 | Okada et al. | |
| 5,355,964 | A | | 10/1994 | White | |
| 5,363,835 | A | | 11/1994 | Robson | |
| 5,570,975 | A | * | 11/1996 | Reinert, Sr. | 405/232 |
| 5,697,457 | A | * | 12/1997 | Back | 173/185 |
| 6,000,477 | A | | 12/1999 | Campling et al. | |
| 6,095,257 | A | | 8/2000 | Lee | |
| 6,119,795 | A | | 9/2000 | Lee | |
| 6,227,307 | B1 | | 5/2001 | Lee | |
| 6,257,352 | B1 | | 7/2001 | Nelson | |
| D457,534 | S | | 5/2002 | Kim | |
| 6,732,814 | B2 | | 5/2004 | Heinonen et al. | |
| D547,775 | S | | 7/2007 | Tuscuoglu | |
| 7,628,222 | B2 | | 12/2009 | Yoshimura et al. | |
| 8,061,439 | B2 | * | 11/2011 | Nelson | 173/210 |

* cited by examiner

*Primary Examiner* — Gloria R Weeks
(74) *Attorney, Agent, or Firm* — Moore & Hansen, PLLC

(57) ABSTRACT

A rock breaking device employs a falling weight and a striker pin or other tool held within a tool holding structure supported by a recoil assembly includes a number of isolator structures that protect the rock breaking device by absorbing excess forces that may be applied to the recoil assembly. Each isolator structure includes a front plate that extends below a lower side of a recoil tube flange. In new rock breaking devices, the front plates may be incorporated as part of the isolator structures. Alternatively, an existing rock breaking device can be retrofitted by welding a heavy plate onto the front of an existing front plate of the isolator structures. The heavy plate extends beyond the lower side of the recoil tube flange to provide greater strength.

14 Claims, 7 Drawing Sheets

ISOLATOR PLATE ASSEMBLY FOR ROCK BREAKING DEVICE

RELATED APPLICATIONS

The present application is a continuation-in-part of U.S. patent application Ser. No. 11/873,067, filed Oct. 16, 2007 now U.S. Pat. No. 8,061,439, which is hereby incorporated herein by reference.

TECHNICAL BACKGROUND

The disclosure relates generally to the breaking of rocks, stones, ores, slag, construction materials, and the like, collectively referred to in this disclosure as "rocks," to concrete demolition, to pile driving, and to compaction of sand, dirt, and earth. More particularly, the disclosure relates to devices employing a falling weight to accomplish such tasks.

BACKGROUND

In the construction industry and other industries, it is often desirable to break rocks, stones, ores, construction materials, and the like, collectively referred to in this disclosure as "rocks." Some prior art devices used to achieve this purpose employ a falling weight to break such rocks. In particular, a massive weight is allowed to fall under the influence of gravity and impact a tool that is driven into the rock to break it.

While such devices can be quite effective in breaking rocks, the forces that are imparted by repeated heavy blows from a weight being used to drive a tool can easily exceed the maximum allowed stresses in the materials from which typical rock breaking devices are made, such as steel. Some conventional rock breaking devices attempt to address this issue by cushioning the impact of the weight on the tool using, for example, elastomeric cushions or other shock absorbers formed of rubber, leather, or wood. When the cushion or buffer is vertically compressed under the weight, however, it expands laterally. As a result, the cushion or buffer may come into contact with the side walls of the rock breaker and exert sufficient force on the side walls to deform or break them.

Further, in some cases, a weight may drop within a rock breaking device without any object beneath the tool or without support for the tool itself. In this scenario, the entire force of the falling weight is transferred to the tool and the lower end of the rock breaking device. This situation, known as "dry firing" or "bottoming out," results from the force of the falling weight being transferred to the lower end of the rock breaking device rather than to a rock. Bottoming out or dry firing a rock breaking device even once can cause severe damage to the rock breaking device, as well as to any vehicle or stand to which the rock breaking device may be attached.

U.S. Pat. No. 6,257,352, issued to Nelson on Jul. 10, 2001, discloses a rock breaking device that includes a substantially vertical guide column. The guide column houses a weight for delivering an impact to a tool held within a cushioned tool holding structure. The cushioned tool holding structure is supported from the guide column by a resilient recoil assembly mounted at the bottom end of the guide column. When excess force is applied to the recoil assembly, the recoil assembly causes the force of the falling weight to be transferred to and absorbed by elastomeric isolator buffers, reducing the potential for damage to the rock breaking device.

In some conventional rock breaking devices, the tool that is driven into the rock is also used to move the rock into the desired position before breaking it. Using the tool in this manner can impart considerable stress on various components of the rock breaking device. Over time, the integrity of the rock breaking device can be compromised.

SUMMARY OF THE DISCLOSURE

According to various example embodiments, a rock breaking device that employs a falling weight and a striker pin or other tool held within a tool holding structure supported by a recoil assembly includes a number of isolator structures that protect the rock breaking device by absorbing excess forces that may be applied to the recoil assembly during rock breaking and during rock positioning prior to breaking. Each isolator structure includes a front plate that extends below a lower side of a recoil tube flange. In new rock breaking devices, the front plates may be incorporated as part of the isolator structures. An illustrative method of incorporating a front plate onto an isolator structure may include the steps of: providing a mast having an upper end portion, a lower end portion, a vertical axis, an external surface, and a generally u-shaped isolator structure that is attached to the external surface and which extends outwardly therefrom, the isolator structure having opposing, spaced-apart sides, a bottom flange; b. providing an isolator plate; c. positioning the isolator plate so that a first portion of the isolator plate is adjacent to edges of the spaced-apart sides and the bottom flange of the isolator structure, and a second portion of the isolator plate extends below the bottom flange; and d. attaching the isolator plate to the isolator structure. As will be appreciated, the sequence of the steps of the above illustrative method may be modified. For example, the isolator plate may be attached to the generally u-shaped structure prior to attaching the u-shaped structure to the mast. Or, one or more portions of the isolator structure may be attached to the mast, other portions or portions of the isolator structure may be attached to the isolator plate and then the two partially assembled structures connected to each other. Alternatively, an existing rock breaking device may be retrofitted by welding a heavy plate onto the front of an existing front plate of the isolator structure. An illustrative method of retrofitting a front plate onto an isolator structure that already includes a front plate that covers only the outwardly opening edges of an inverted u-shaped pocket may include the steps of: providing a mast having an upper end portion, a lower end portion, a vertical axis, an external surface, and a generally u-shaped isolator structure that is attached to the external surface and which extends outwardly therefrom, the isolator structure having opposing, spaced-apart sides, a bottom flange, and a front plate attached to the sides and the bottom flange; b. providing an isolator plate; c. positioning the isolator plate so that a first portion of the isolator plate substantially overlies the existing front plate of the isolator structure, and a second portion of the isolator plate extends below the bottom flange; and d. attaching the isolator plate to the isolator structure. In both above methods, a portion of the heavy plate extends beyond the lower side of the recoil tube flange to provide greater strength to the rock breaking device.

An illustrative embodiment is directed to a device for breaking rocks. The rock breaking device includes a hollow mast having a lower end portion. The hollow mast defines a vertical axis and a channel running at least substantially parallel to the vertical axis. A weight is slidably disposed in the channel. A weight raising arrangement is provided for raising and releasing the weight to allow the weight to fall within the channel under the influence of gravity. A recoil arrangement includes a recoil tube having an upper end portion and a lower end portion extending below the lower end portion of the mast. The recoil tube is resiliently secured proximate the lower end portion of the mast. An upper flange (or collar) and a lower flange (or collar) are secured to the upper and lower end portions, respectively, of the recoil tube. An isolator arrangement includes an isolator structure secured proximate the lower end portion of the mast and proximate the upper end portion of the recoil tube and arranged to support the recoil tube. An isolator plate is secured to the isolator structure such that a portion of it is able to extend below the upper flange in a skirt-like manner. A nose block is secured proximate the lower end portion of the recoil tube. The nose block has an upper surface and a bore formed through the nose block so as to slidably receive a tool therein. An impact-absorbing recoil buffer is disposed within the recoil tube in a space defined between the lower end portion of the mast and the upper surface of the nose block. The recoil buffer is constructed and arranged to resiliently absorb impact forces imparted to the recoil buffer by the weight. In some alternative embodiments, the impact-absorbing recoil buffer may incorporate one or more springs.

In another illustrative embodiment, a rock breaking device comprises a hollow mast having a lower end portion and defining a vertical axis and a channel running at least substantially parallel to the vertical axis. A weight is slidably disposed in the channel. A weight raising arrangement is provided for raising and releasing the weight to allow the weight to fall within the channel under the influence of gravity. A recoil arrangement comprises a recoil tube having an upper end portion and a lower end portion extending below the lower end portion of the mast. The recoil tube is resiliently secured proximate the lower end portion of the mast. An upper flange is secured to the upper end portion of the recoil tube. A tool holding structure is secured proximate the lower end portion of the recoil tube and is configured to receive a tool. An elastomeric recoil buffer is disposed within the recoil tube in a space defined between the lower end portion of the mast and the upper surface of the nose block. The recoil buffer is constructed and arranged to resiliently absorb impact forces imparted to the recoil buffer by the weight. An isolator arrangement comprises an isolator structure secured proximate the lower end portion of the mast and proximate the upper end portion of the recoil tube and arranged to support the recoil tube. An isolator plate is secured to the isolator structure such that a portion of it is able to extend below the upper flange (in a skirt-like manner) and is arranged to alleviate stresses imparted to the rock breaking device when the recoil arrangement, tool holding structure, and tool are used to position a rock for breaking.

Various embodiments may provide certain advantages. For instance, when the striker pin, the nose block, and the recoil tube are used to position rocks for breaking, a great deal of stress can be placed on the portion of the mast below the side isolator flange, the side isolator bolts, and the side isolator buffers. Adding the plates to the isolator structures may increase the life of these parts and make the rock breaking device more dependable.

Additional objects, advantages, and features will become apparent from the following description and the claims that follow, considered in conjunction with the accompanying drawings.

DESCRIPTION OF VARIOUS EMBODIMENTS

According to various embodiments, a rock breaking device that employs a falling weight and a striker pin or other tool held within a tool holding structure supported by a recoil assembly includes a number of isolator structures that protect the rock breaking device by absorbing excess forces that may be applied to the recoil assembly. Each isolator structure may include a front plate having a portion or skirt that may extend below a lower or underside of an upper or first recoil tube flange. In new rock breaking devices, the front plates may be incorporated as part of the isolator structures. Alternatively, an existing rock breaking device can be retrofitted by welding a secondary, skirted front plate onto the front of an existing primary, non-skirted front plate of the isolator structures so that the skirted portion of the secondary front plate is able to extend below the lower side of the upper or first recoil tube flange. In another embodiment, the front plate may generally be in the form of an inverted "T," and include side extensions or wings that extend laterally beyond the sides of an isolator structure and includes a lower portion or skirt that extends below the lower side of an upper recoil tube flange. As with the previously described embodiments, the inverted "T" front plate may form part of a pocket structure in an isolator structure, or the front plate may be a secondary front plate that is attached to an isolator structure that already includes a primary front plate that forms a pocket structure. The front plates serve to stabilize and strengthen the rock breaking device in a plurality of axes.

In the following description, numerous specific details are set forth in order to provide a thorough understanding of various embodiments. It will be apparent to one skilled in the art that some embodiments may be practiced without some or all of these specific details. For example, this disclosure recites certain dimensions. Such recitations are provided by way of illustration only, and are not intended to limit the scope of the invention. Indeed, other dimensions may be more appropriate for use with certain models of rock breaking devices. In other instances, well known components and process steps have not been described in detail.

Figure 1:
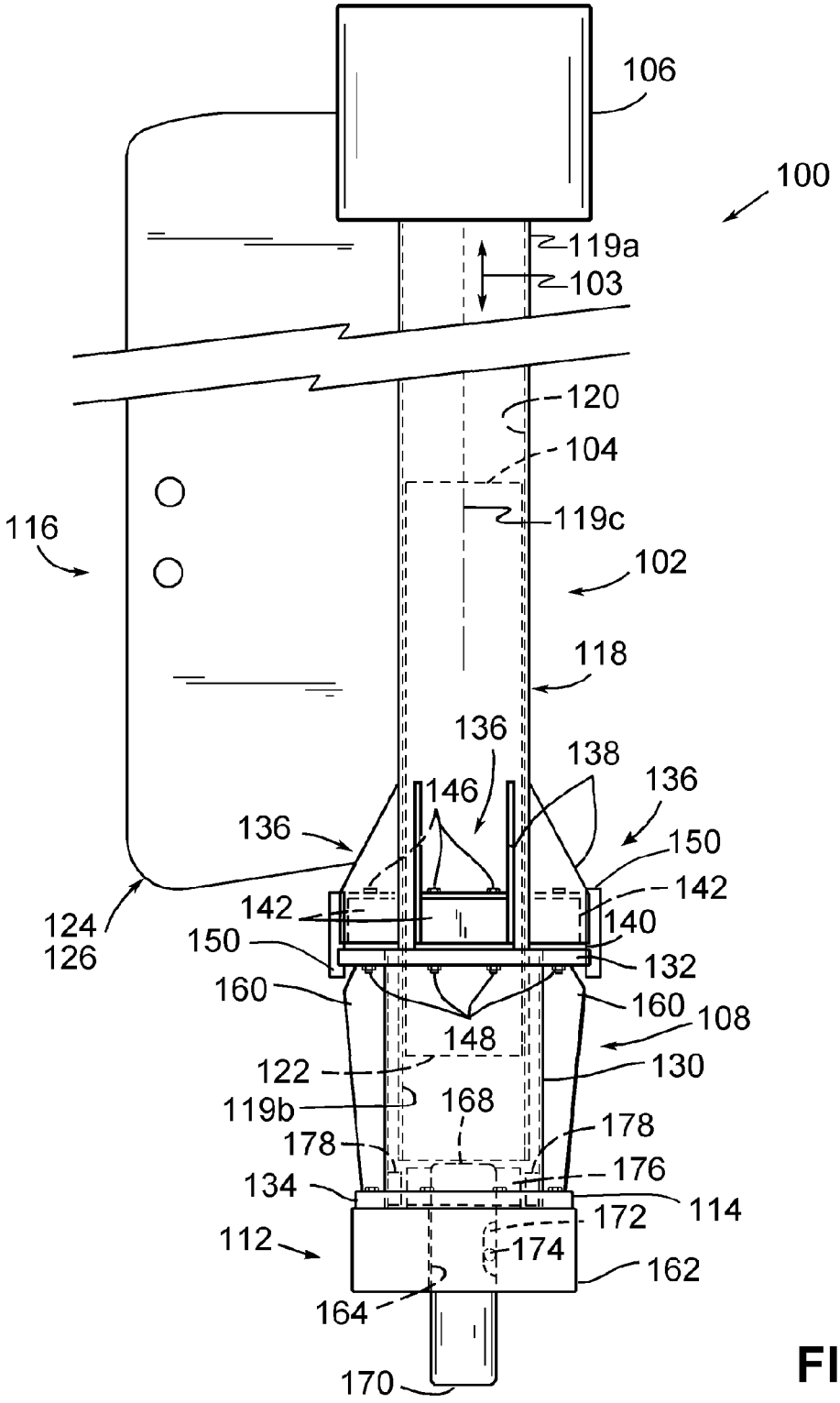
FIG. 1 is a side view of a rock breaking device according to one embodiment.

Referring now to the drawings, FIG. 1 is a side view of a rock breaking device 100 according to one embodiment. The rock breaking device 100 is generally comprised of a guide column 102 constructed and arranged to permit free vertical movement of an impact weight 104 through the guide column 102 in directions 103. A weight raising mechanism 106 is configured and arranged to raise and release the impact weight 104 within the guide column 102. A recoil assembly 108 is secured to a lower end 110 of the guide column 102. A tool holding structure 112 is mounted to a lower end 114 of the recoil assembly 108. A vehicle attachment structure 116 is secured to the guide column 102 to provide a point of attachment for the rock breaking device 100 to a vehicle, such as a front-end loader or excavator (not shown) that is used to transport and position the rock breaking device 100. Alternatively, the rock breaking device 100 can be positioned in other ways, including, for example, mounting upon a stationary rock breaking structure or suspension from a crane.

The guide column 102 of the rock breaking device 100 comprises a tubular mast 118 having a first or upper end 119*a*, a second or lower end 119*b* and a longitudinal axis 119*c*. In one embodiment, the mast 118 has a generally square cross section; however, the mast 118 may have any of a number of suitable cross-sectional shapes, including, but not limited to, a square, rectangular, polygonal, elliptical, or circular cross section. The mast 118 is typically formed from a high strength steel. The mast 118 has a channel or passage 120 running through the mast 118 along the longitudinal axis 119*c* in a coincident manner, with the channel serving to guide an impact weight 104 as it travels along the channel 120 between the first end 119*a* and the second end 119*b* of the mast 118. Note that the second end 119*b* of the mast 118 is located adjacent the tool holding structure 112 located at a lower end of the recoil assembly 108. The impact weight 104 is typically formed from a steel material, but other materials may be used. It is generally desirable, however, that the impact weight 104 should be formed from a material that is strong and tough enough to prevent the rapid deformation of a lower impact surface 122 of the impact weight 104.

The impact weight 104 is coupled to the weight raising mechanism 106 mounted adjacent the upper end of the guide column 102. The weight raising mechanism 106 can be any of a number of well known mechanisms capable of raising and releasing a heavy object, such as the impact weight 104. Examples of suitable weight raising mechanisms include, but are not limited to, hydraulic lifting mechanisms, pneumatic lifting mechanisms, and mechanical mechanisms that may include cable and pulley structures, gear trains, rack and pinions, or rotating cam mechanisms. The weight raising mechanism 106 should be capable of repeatedly raising and subsequently releasing the impact weight 104 to allow the impact weight 104 to fall within the channel 120 of the mast 118 under the influence of gravity when the first end 119*a* of the mast is located above the second end 119*b* of the mast 118. In illustrative embodiments, the mast 118 is substantially vertically oriented, however it is understood that the mast 118 may be angled from the vertical without departing from the spirit and scope of the invention. For example, it is envisioned that in some embodiments, the mast 118 may be angled approximately 45 degrees or more from vertical. Power for the weight raising mechanism 106 is typically supplied by the vehicle or structure on which the rock breaking device 100 may be mounted. For example, an air compressor, hydraulic pump, or generator may be mounted on the vehicle or structure to which the rock breaking device 100 is mounted so as to provide the motive power to the weight raising mechanism 106. Alternatively, power for the weight raising mechanism 106 may be provided by an internal combustion engine coupled directly to the weight raising mechanism 106.

In one embodiment, the vehicle attachment structure 116 includes a pair of substantially parallel side plates 124, 126 that are affixed longitudinally to the guide column 102. The plates 124, 126 are maintained in their substantially parallel arrangement by a number of brackets or cross-braces (not shown) welded between the plates 124, 126 in a well known manner. The brackets are further arranged in a known manner to secure the rock breaking device 100 to a vehicle that will be used to deploy the rock breaking device 100. As indicated above, suitable vehicles include front-end loaders and excavators capable of movement through the environments in which a rock breaking device 100 would be used, such as a mine, rock quarry, or construction site. The plates and/or brackets of the attachment structure 116 may be provided with standardized attachment holes that have the same configuration and arrangement or pattern as attachment holes of an excavating bucket of a backhoe, for example. To connect the rock breaking device to a backhoe, all one needs to do is remove the excavating bucket and replace it with the rock breaking device—using the same pivot pin connecting elements and the similarly arranged and sized attachment holes. After the excavating bucket has been replaced by the rock breaking device, an operator of the backhoe can control the movement of the rock breaking device in a normal fashion using the same bucket control mechanisms. Alternatively, the brackets may instead be arranged in a known manner to secure the rock breaking device 100 to a stationary structure, such as a pedestal or stationary framework, rather than a movable vehicle.

The rock breaking device 100 functions by transmitting forces from the dropped impact weight 104 to a target rock through a tool 128 mounted in the tool holding structure 112. The recoil assembly 108 prevents the massive forces generated by the falling impact weight 104 from rapidly destroying the tool holding structure 112 and the guide column 102. In addition, the tool holding structure 112 is preferably cushioned to further prevent its rapid destruction.

Figure 2:
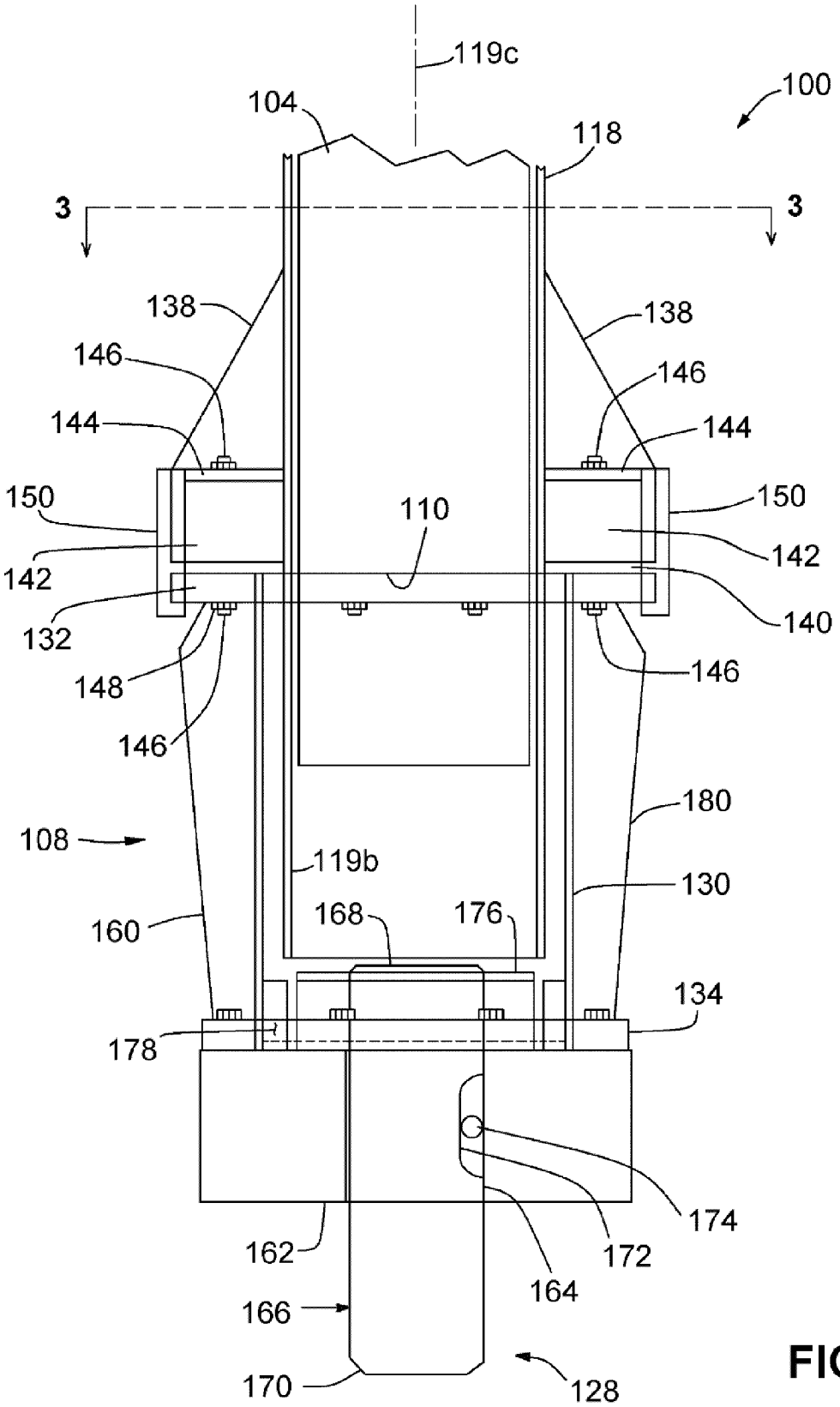
FIG. 2 is a close-up view of a lower end of a guide column and another embodiment of a recoil assembly attached to the guide column of the rock breaking device.

FIG. 2 illustrates a close-up view of a lower end of the guide column 102 and the recoil assembly 108 that is movably attached to the guide column 102 of the rock breaking device 100 depicted in FIG. 1. The recoil assembly 108 includes a recoil tube 130 having a first or upper flange 132 and a second or lower flange 134 secured to the upper and lower ends, respectively. The recoil tube 130 is movably connected to the lower end of the guide column 102 in telescoping, concentric fashion by one or more isolator structures 136 that are secured to the mast 118 a predetermined distance from the lower end 119*b* of the mast 118.

Figure 4:
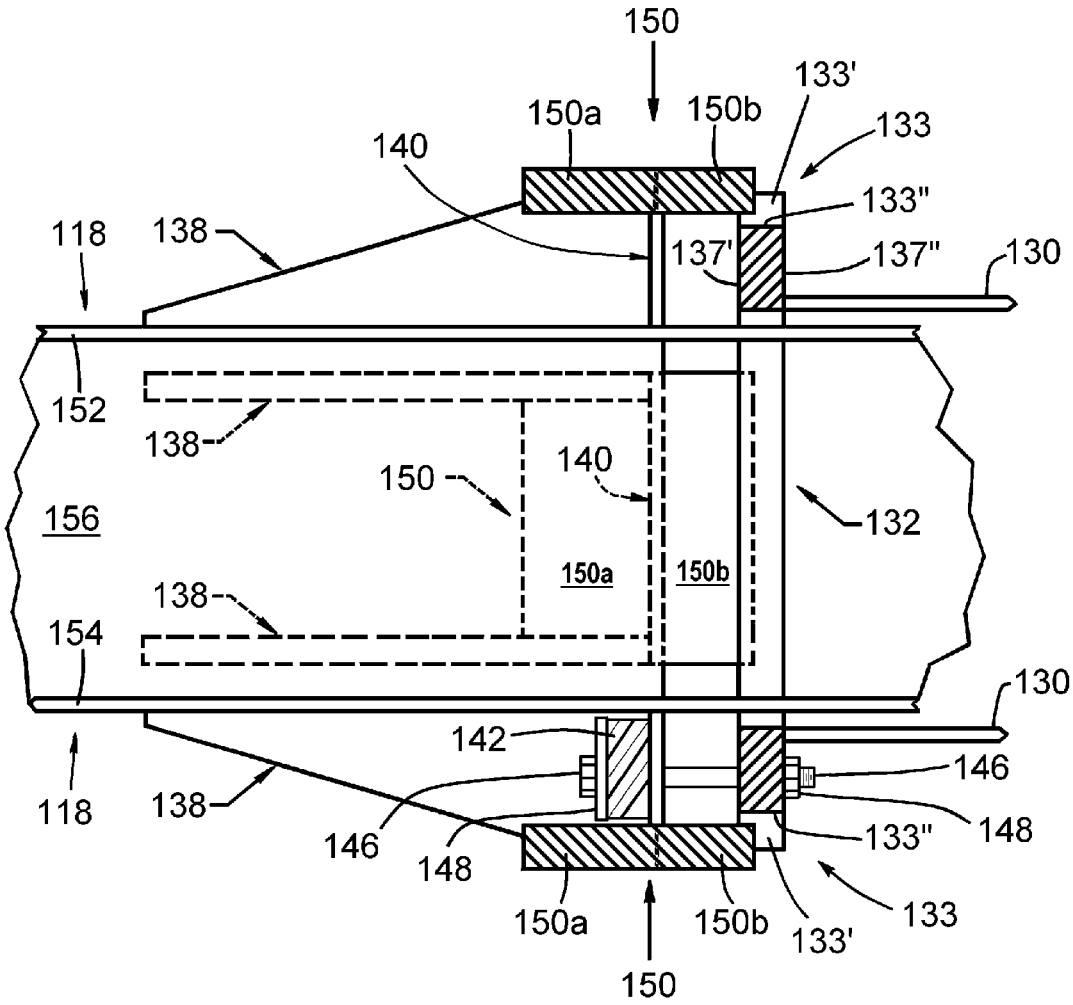
FIG. 4 is a partial, cross-sectional view of the recoil assembly of the rock breaking embodiments depicted in FIGS. 1-3, taken along section lines 4-4 in FIG. 3.
Figure 5:
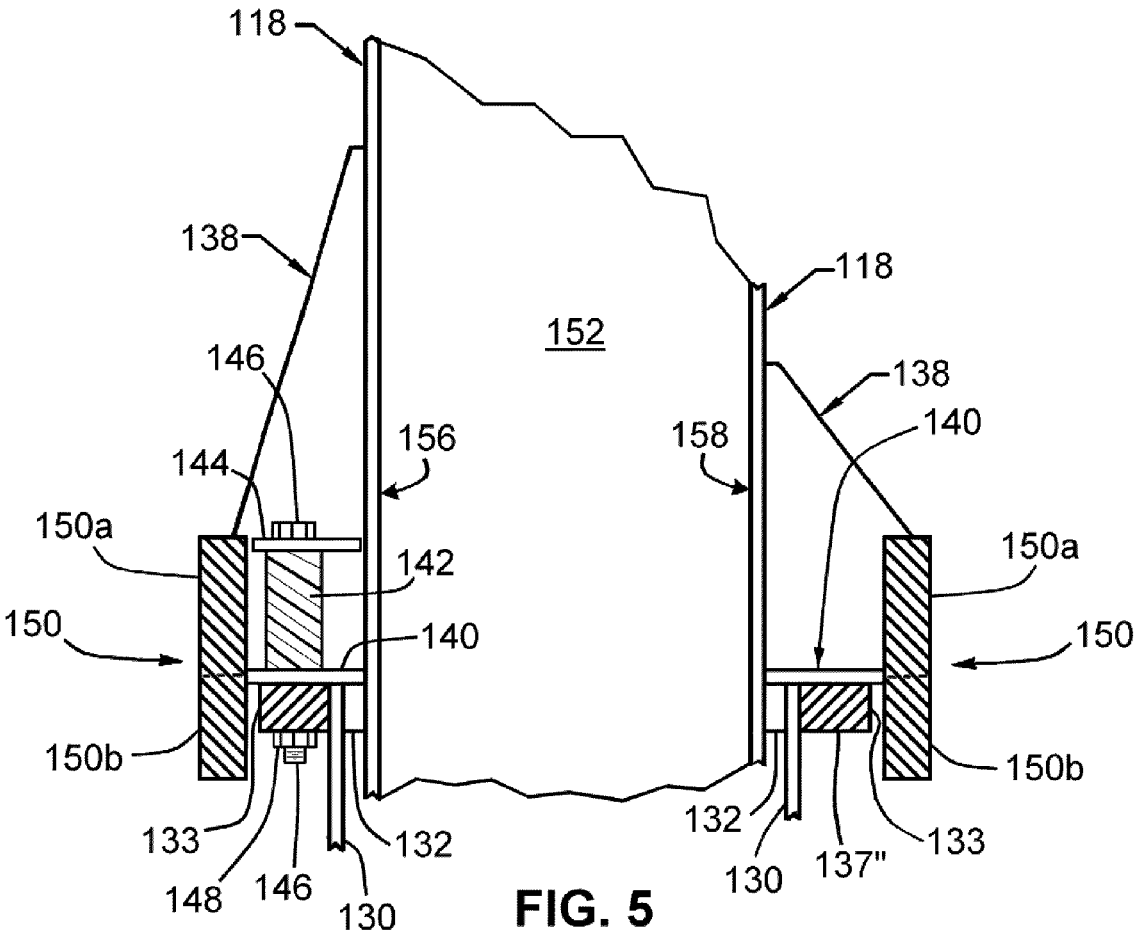
FIG. 5 is a partial, cross-sectional view of the recoil assembly of the rock breaking embodiments depicted in FIGS. 1-3, taken along section lines 5-5 in FIG. 3.

Each isolator structure 136 comprises a bracket formed from a pair of vertical plates 138 and a horizontally oriented flange 140. In some embodiments, the vertical plates 138 are attached to the mast 118 in parallel relation to one another and the longitudinal axis 119*c* of the mast 118. The horizontally oriented side isolator flange 140 is secured to the lower ends of the vertical plates 138 and to the mast 118. Together, the vertical plates 138, the side isolator flange 140, and the portion of the mast 118 to which the plates 138 and flange 140 are attached form an isolator structure and define an upwardly opening pocket in which a side isolator buffer 142 may be positioned. The side isolator buffer 142 is preferably formed from an elastomeric material such as, for example, rubber. As an alternative, the side isolator buffer 142 may incorporate one or more heat resistant spring elements, such as metallic strings, in addition to or instead of the elastomeric material. Such a construction may be particularly advantageous for use in high temperature environments, for example, environments in which the temperature may exceed 180° F. In one embodiment, bolt holes 140' (see, FIG. 6) are formed through each horizontally oriented side isolator flange 140. Bolt holes 142' (see, FIG. 6) are formed through the side isolator buffer 142 such that when the side isolator buffer 142 is received within the pocket formed by the vertical plates 138, the side isolator flange 140, and the mast 118, the bolt holes 142' formed through the side isolator buffer 142 can be brought into registration with the bolt holes 140' formed in the horizontally oriented side isolator flange 140 (see also, FIG. 6). Some embodiments of the isolator structures may include a horizontally oriented cover plate 144 that may include one or more bolt holes 144' (see, FIG. 6) formed therethrough, with the bolt holes 144' configured and arranged so that they can be brought into registration with the bolt holes 142' formed through the side isolator buffer 142 and in registration with the bolt holes 140' located in the horizontally oriented side isolator flange 140. Side isolator bolts 146 pass through the apertures in the cover plate 144, the side isolator buffer 142, and the side isolator flange 140 and through apertures "A" in the first or upper flange 132, where they may be secured from beneath the flange 132 at bottom surface 137" by nuts 148, so as to movably secure the recoil tube flange 132 to the guide column 102 of the rock breaking device 100 (see, for example FIGS. 4 and 5, which depict displacement between isolator structures 136 and an upper recoil tube flange 132). In practice, the resilient isolator buffers 142 of the isolator structures urge the recoil tube flange 132 towards the underside of the side isolator flanges 140 of the isolator structures 136 as shown in FIG. 5, yet allow the flange 132 to be displaced from underside of flange 140 as shown in FIG. 4.

Figure 6:
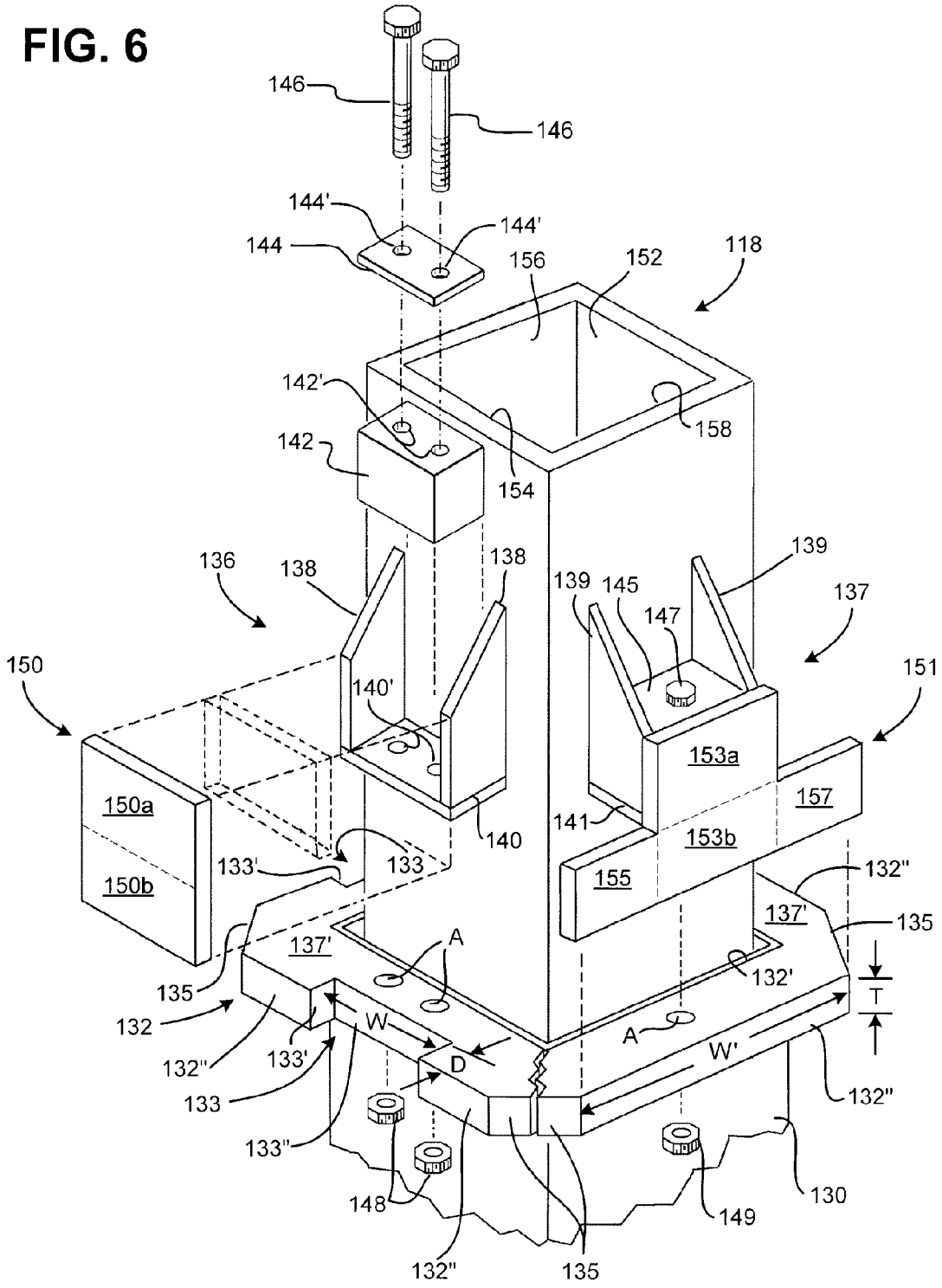
FIG. 6 is a partial perspective view of several isolator structure and upper recoil tube flange embodiments.

In the embodiment shown in FIG. 2, each of the pockets formed by a pair of vertical plates 138, a horizontally oriented side isolator flange 140 and a portion of the mast 118 may include a side isolator front plate 150 that is attached to, and which further defines the pocket. As depicted in FIG. 6, the front plate 150 includes a first or upper portion 150*a* and a second or lower portion (or skirt) 150*b*, with the first portion 150*a* configured and arranged to cover an outwardly opening portion of the pocket that is generally u-shaped and which is defined by edges of the vertical plates 138 and the horizontally oriented flange 140. The second portion or skirt 150*b* is configured and arranged to project downwardly below the flange 140 of the isolator structure 136. In an illustrative embodiment, the second or lower portion 150*b* is spaced from the recoil tube 130 and extends below the upper surface 137' of the recoil tube flange 132. In a preferred embodiment, the lower portion 150*b* is spaced from the recoil tube 130 and extends below the bottom surface or underside 137" of the recoil tube flange 132 in a cantilever manner (FIGS. 2, 6). Each side isolator front plate 150 may be welded or otherwise affixed to the corresponding horizontally oriented side isolator flange 140 and to the vertical plates 138 and may be configured and arranged to be able to fit into a slot 133 (FIG. 6) formed in the upper or first recoil tube flange 132.

The side isolator front plates 150 (and 151 discussed below) enhance the security and positioning of the side isolator buffers 142 within the isolator structures 136 and constrain lateral expansion of the side isolator buffers 142 during impact and also during positioning of rocks with the device. In this way, the side isolator front plates 150 reduce the stress that is typically placed on the side isolator bolts 146, the side isolator buffers 142, and the portion of the mast 118 below the side isolator flange 140, particularly when positioning rocks with the tool 128 and the recoil tube 130. Adding the side isolator plates 150 increases the life of these parts and improves the stability, strength, durability, and useful lifespan of the rock breaking device 100.

In some embodiments, a conventional rock breaking device can be retrofitted with the side isolator front plates 150 and 151. For example, side isolator front plates 150 may be welded or otherwise affixed onto existing front plates of the isolator structures 136 (see, FIG. 6, which depicts, in phantom on the left side, an existing, primary plate that interposed between a front plate 150 and an isolator structure 136). When a front plate 150 is attached over an existing, primary front plate, the front plate 150 will be positioned further away from the mast. This means that each side isolator front plate 150 will be juxtaposed over a straight, outwardly facing edge surface of the recoil tube flange 132, and the flange 132 need not be provided with an outwardly opening slot 133 as with other embodiments (see, FIG. 6). As will be discussed later in an illustrative embodiment, a front plate 150 may be attached directly to vertical plates 138 and a horizontally oriented isolator flange 140. In such embodiments, the front plate 150 may be used in conjunction with a slotted or unslotted upper or first recoil flange 132 (FIG. 6).

An embodiment of an isolator structure and an alternatively configured front plate is also depicted in FIG. 6 on the right side thereof. Here, an isolator structure 137 comprises a bracket formed from a pair of vertical plates 139 and a horizontally oriented flange 141. The vertical plates 139 are attached to the mast 118 in parallel relation to one another and to the longitudinal axis 119*c* of the mast 118, and the horizontally oriented side isolator flange 141 is secured to the lower ends of the vertical plates 139 and to the mast 118. Together, the vertical plates 139, side isolator flange 141, and the portion of the mast 118 to which the plates 139 and flange 141 are attached form an isolator structure 137 and defines an upwardly opening pocket in which a side isolator buffer may be positioned (see, for example the buffer 142 used with isolator structure 136). The isolator buffer is preferably formed from an elastomeric material such as, for example, rubber. As an alternative, the side isolator buffer may incorporate one or more spring elements in addition to or instead of the elastomeric material.

In the above embodiment, one or more bolt holes (not shown) are formed through each horizontally oriented side isolator flange 141. Bolt holes (not shown) are also formed through the side isolator buffer 142 such that when the side isolator buffer 142 is received within the pocket formed by the vertical plates 139, side isolator flange 141, and the mast 118, the bolt holes formed through the side isolator buffer 142 can be brought into registration with the bolt holes formed in the horizontally oriented side isolator flange 141. Some embodiments of the isolator structures may include a horizontally oriented cover plate 145 that may include one or more bolt holes (not shown) formed therethrough, with the bolt holes configured and arranged so that they can be brought into registration with the bolt holes formed through the side isolator buffer 142 and in registration with the bolt holes located in the horizontally oriented side isolator flange 140. One or more isolator bolts 147 pass through the apertures in the cover plate 145, the side isolator buffer 142, and the side isolator flange 141 and through aperture(s) "A" in the first or upper flange 132, where they may be secured from beneath the flange 132 at bottom surface 137" by nut(s) 149, so as to movably secure the recoil tube flange 132 to the guide column 102 of the rock breaking device 100 (see, for example FIGS. 4 and 5, which depict displacement between isolator structures 136 and an upper recoil tube flange 132).

In the embodiment shown on the right side of FIG. 6, each of the pockets formed by a pair of vertical plates 139, a horizontally oriented side isolator flange 141 and a portion of the mast 118 may include a side isolator front plate 151 that is generally in the form of an inverted "T", and which is attached to the pocket. As depicted in FIG. 6, the front plate 151 includes a first or upper portion 153*a* and a second or lower portion (or skirt) 153*b*, a first side extension or wing 155 and a second side extension or wing 157. The first portion 153*a* (which is approximately 6½ inches wide and 5¼ inches high) is configured and arranged to cover an outwardly opening portion of the pocket that is generally u-shaped and which is defined by edges of the vertical plates 139 and the horizontally oriented flange 141. The second portion or skirt 153*b* (which is approximately 6½ inches wide and 2½ inches high) is configured and arranged to project downwardly below the flange 141 of the isolator structure 137. The first side extension or wing 155 (which is approximately 4 inches high and approximately 2½ inches wide) is configured and arranged to project laterally in a first direction away from the second portion 153*b* and the second side extension or wing 157 (which is approximately 4 inches high and 2½ inches high) is configured and arranged to project laterally in a second direction away from the second portion 153*b*. In some embodiments the front plate 151 is substantially planar and has a thickness of approximately 1¼ inches. The isolator plate need not be held to the above preferred dimensions and other combinations and size ranges of widths, heights and thickness may be used without departing from the spirit and scope of the invention. In an illustrative embodiment, the second or lower portion 153*b* is spaced from the recoil tube 130 and extends below the upper surface 137' of the recoil tube flange 132. In a preferred embodiment, the lower portion or skirt 153*b* is spaced from the recoil tube 130 and extends below the bottom surface or underside 137" of the recoil tube flange 132 in a cantilever manner (FIG. 6). In illustrative embodiments, the first and second side extensions 155, 157 define a width that is greater than the width of the isolator structure 137 and less than the width W' of the recoil tube upper flange 132. Preferably width defined by the first and second side extensions 155 and 157 is greater than the transverse width of the mast 118. When a plurality of front plates 151 are used in conjunction with a plurality of isolator structures 137, the side extensions 155 and 157 of adjacent front plates 151 will confront each other and the side plates 151 will effectively encircle an upper flange 132. This substantially increases the overall strength of the rock breaking device. Each side isolator front plate 151 may be welded or otherwise affixed to the corresponding horizontally oriented side isolator flange 141 and to the vertical plates 139 and may be configured and arranged to be able to be used with an upper flange 132 that is slotted 133 or unslotted.

When excess force is applied to the recoil assembly 108, such as when the tool 128 is bottomed out or dry fired, the recoil assembly 108 is forced downward. This excess force causes the recoil assembly 108 to move downward relative to the guide column 102. Rather than applying these forces directly to the guide column 102, as would be the case if the bolts 146 were used to connect the horizontally oriented side flange 140 directly and immovably to the upper flange 132, the downward movement of the recoil assembly 108 causes the side isolator bolts 146 in the isolator structures 136 to compress the elastomeric or resilient side isolator buffers 142 and absorb the excess forces that were applied to the recoil assembly 108. This allows the upper flange 132 of the recoil tube to move relative to the horizontal flange 140 and the lower portion 150*b* of the isolator plate 150 (or lower portions 153*b*, 155 and 157 relative to horizontal flange 141 as the case may be). As depicted in FIG. 4, an excess force has been applied to the recoil assembly so that the first or upper surface 137' of flange 132 is spaced from the underside or bottom of flange 140. As a result of providing the additional isolator structures such as 136 and 137, stress can be distributed to the side isolator bolts 146 or 147 as well as a recoil buffer 176 located at a lower end of the tool holding structure 112. The side isolator front plates 150 and 151 also tend to alleviate this stress, and extend the life of the side isolator bolts 146 and 147.

Figure 3:
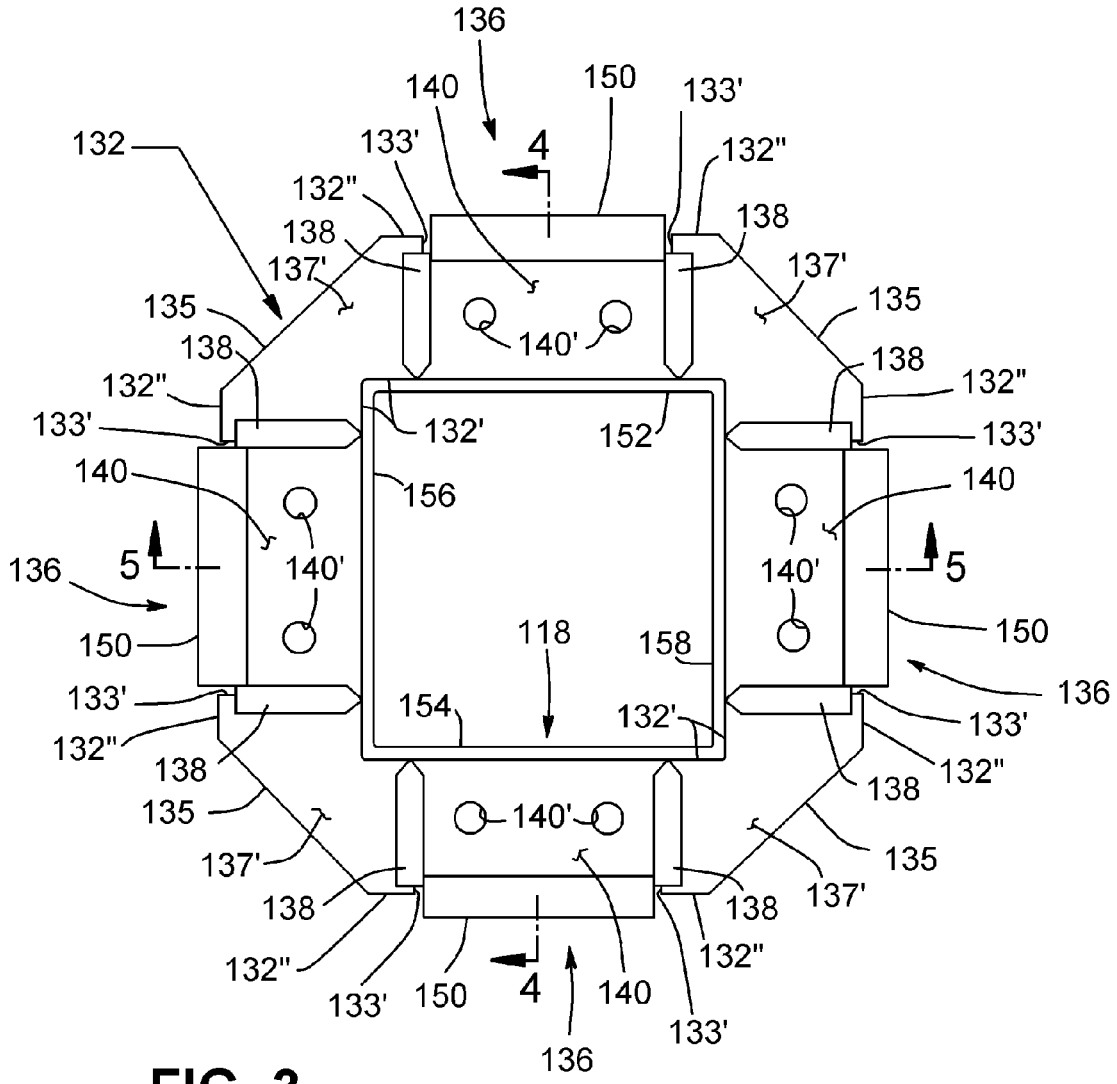
FIG. 3 is a partial, top plan view of an embodiment of a mast, a plurality of isolator pocket structures, and an upper recoil tube flange of a rock breaking device, taken along section lines 3-3 in FIG. 2.

FIG. 3 is a partial, top plan view of an embodiment of a recoil assembly of the rock breaking device depicted in FIG. 2, taken along section lines 3-3 in FIG. 2. Note that impact weight 104 has been omitted for clarity. In the embodiment depicted in FIG. 3, four isolator structures 136, whose isolator buffers 142, cover plates 144 and bolts 146 have also been omitted for clarity, are secured to the mast 118, one on each side 152, 154, 156 and 158 of the mast 118. It will be appreciated by those of skill in the art that, while FIG. 3 depicts four isolator structures 136 that correspond to the four sides 152, 154, 156, 158 of the mast 118, other embodiments may employ more or fewer isolator structures 136. For example, if the recoil tube 130 has a polygonal cross-section such as a hexagon, more than four isolator structures 136 may be secured to the mast 118. Alternatively, if an upper or first recoil flange includes more outwardly facing edge surfaces than there are sides of a mast, each edge surface may be provided with an isolator structure. Thus, as shown in FIG. 3, the truncated edges 135 may also be provided with one or more corresponding isolator structures in addition to the isolator structures already depicted. Each isolator structure 136 is formed by a pair of vertical plates 138, a horizontally oriented side isolator flange 140, and a side isolator front plate 150. Each pair of vertical plates 138, an associated portion of a side of the mast (152, 154, 156, or 158) and a horizontally oriented side isolator flange 140 form an upwardly and outwardly opening pocket that is covered by a first or upper portion 150*a* of side isolator front plate 150. The front plate 150 also includes a second or lower portion (or skirt) 150*b* that has an end that extends below the bottom or underside 137" when the recoil tube 130 is not subject to shock loading (FIG. 5), and is able to extend below the upper surface 137' of the recoil tube flange 132 when the recoil tube 130 is displaced by shock loading (FIG. 4). In the embodiment illustrated in FIG. 3, the vertical plates 138 in each pair of vertical plates 138 are spaced apart from each other by approximately 11 inches, and the side isolator front plate 150 is spaced apart from the tubular mast 118 by approximately 5⅜ inches. Accordingly, in the embodiment of FIG. 3, the horizontally oriented side isolator flanges 140 measure approximately 11 inches by 5⅜ inches and have an area of approximately 59 square inches. As shown, the horizontally oriented side isolator flange 140 may include one or more apertures 140' that are configured and arranged to be in registry with apertures "A" of the first or upper recoil flange 132 positioned therebelow (see, FIG. 6). As will be understood, the apertures 140' are also configured and arrange to be in registry with apertures 142' of a resilient isolator buffer 142 and apertures 144' of a cover plate 144 (FIG. 6). As mentioned above, the first or upper flange 132 is movably connected to each isolator structure 136 by one or more bolts 146 and nuts 148. It will be appreciated that these and all other dimensions disclosed herein are intended as examples only, and that other dimensions may be selected in other embodiments. Each first or upper portion 150*a* of side isolator front plate 150 may be welded or otherwise attached to the corresponding horizontally oriented side isolator flange 140 and vertical plates 138. Each second or lower portion (or skirt) 150*b* of side isolator front plates 150 and respective slot 133 are configured and arranged so that they may move relative to each other as the recoil assembly 108 moves relative to the tubular mast 118. In an illustrative embodiment, relative movement between a second or lower portion 150*b* and a slot 133 is constrained and substantially parallel to the longitudinal axis 119*c* of the rock breaking device 100.

FIG. 4 is a partial cross-sectional view of the recoil assembly of the rock breaking device depicted in FIGS. 1-3, taken along section lines 4-4 in FIG. 3. In the embodiment, the recoil tube flange 132 has been displaced, as in by shock loading, so that there is space between the upper surface 137' of the flange 132 and the underside of horizontal flange 140. In the embodiments shown in FIGS. 1-4, the vertical plates 138 forming each pair of vertical plates 138 are spaced apart from one another by approximately 11 inches. The vertical plates 138 forming pockets on opposite sides 152, 154 of the tubular mast 118 are spaced apart from each other by approximately 18¼ inches. The side isolator front plates 150 forming the pockets on the opposite sides 152, 154 of the tubular mast 118 are spaced apart from each other by approximately 28½ inches. The side isolator front plates 150 extend approximately 6½ inches above the recoil tube flange 132.

FIG. 5 is a partial cross-sectional view of the recoil assembly of the rock breaking device depicted in FIGS. 1-3, taken along section lines 5-5 in FIG. 3. In the embodiments shown in FIGS. 1-5, the vertical plates 138 forming pockets on opposite sides 156, 158 of the tubular mast 118 are spaced apart from each other by approximately 17¾ inches. In addition, as shown in FIG. 5, the vertical plates 138 may be of different sizes. For example, in the embodiment shown in FIG. 5, the vertical plates 138 forming the pocket on the side 156 of the tubular mast 118 are approximately 24 inches tall, while the vertical plates 138 forming the pocket on the side 158 of the tubular mast 118 are approximately 14 inches tall. The side isolator front plates 150 forming the pockets on the opposite sides 156, 158 of the tubular mast 118 are spaced apart from each other by approximately 28½ inches. The side isolator plates 150 extend approximately 6½ inches above the recoil tube flange 132 and are approximately 10½ inches in length, with a portion of that length extending below the first or upper recoil tube flange 132.

Figure 7B:
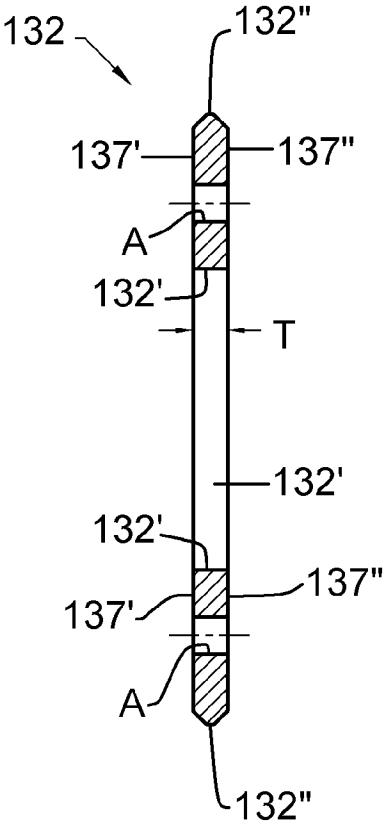
FIG. 7*a* is a top plan view of an embodiment of an upper recoil tube flange and which is useable with one or more isolator structures depicted in FIG. 6; and, FIG. 7*b* is an edge view of FIG. 7.
Figure 7A:
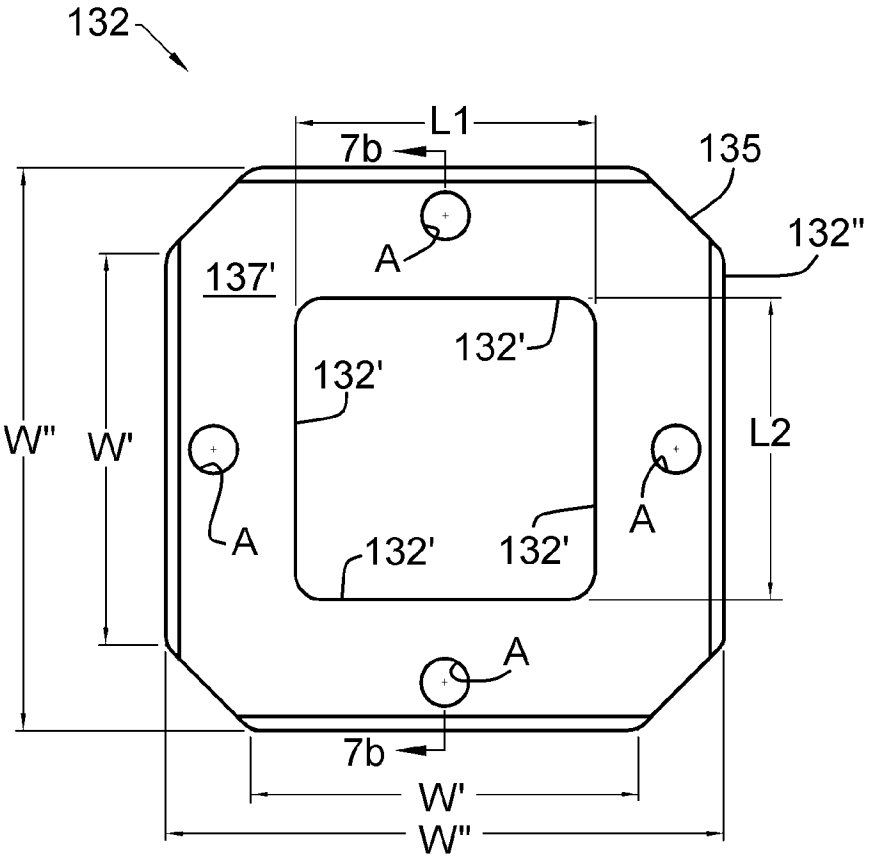

As indicated above in the discussion relating to FIG. 2, the recoil assembly 108 includes a recoil tube 130 having a first recoil tube flange 132 and a second 134 secured to the upper and lower ends, respectively, of the recoil tube 130. As depicted in FIGS. 3, 4, 5 and 6, the first or upper flange 132, which is generally perpendicular to the longitudinal axis 119*c* of the rock breaking device, is generally plate-like and includes a first or upper surface 137' and a second or lower surface 137" that define the thickness "T" of the flange 132. The flange 132 also includes an inwardly facing edge surface 132' and an outwardly facing edge surface 132". In some embodiments the inwardly facing edge surface 132' may be shaped so as to agree with the external surface of the recoil tube 130 to which it is attached (FIG. 6). An illustrative embodiment (FIGS. 7*a* and 7*b*) may include four inwardly facing edges 132' that comprise generally linear sections each having a width L1 and L2. In some embodiments the outwardly facing edge surface 132" may be shaped so as to agree with the number of isolator structures 136 that are used with the rock breaking device. An illustrative embodiment (FIG. 7) may include four outwardly facing edges 132" that comprise generally linear sections each having a width W". In illustrative embodiments, each linear section W" may have a length of approximately 20½ inches. In some embodiments, the linear sections 132" may be truncated 135 where they would normally intersect with each other so as to form a more compact structure, where each linear section W' has a length of approximately 14½ inches. In some embodiments, one or more of the linear sections 132" may be provided with one or more inwardly extending, generally u-shaped transverse slots 133 (FIG. 6) that include end walls 133' and an outwardly facing edge segment 133", with the end walls 133' defining the depth D of the slot 133 and with the outwardly facing edge segment 133" defining the width W of the slot 133. In an illustrative embodiment, the upper flange 132 is generally toroidally shaped and is configured and arranged to substantially encircle the recoil tube 130, to which it is attached. An illustrative embodiment has a thickness of approximately 1¼ inches, inwardly facing surfaces 132' that have lengths L1 and L2 that define a generally square aperture having 11 inch sides, and outwardly facing surfaces 132" having sections W" that define a generally square polygon having parallel sides that are approximately 20½ inches from each other. Referring again to FIG. 2, a number of reinforcing gussets 160 are secured between the first or upper recoil tube flange 132 and the second or lower recoil tube flange 134. The gussets 160 are welded at their top edges to the underside 137" of the recoil tube flange 132 and at their bottom edges to the upper surface of the lower flange 134. In addition, the gussets 160 are preferably welded at an inner edge to the recoil tube 130. In one embodiment, at least four reinforcing gussets 160 are welded to the recoil assembly 108 to stiffen the recoil assembly 108.

A tool holding structure 112 is bolted to the lower flange 134 of the recoil assembly 108. The tool holding structure 112 includes a nose block 162, which may be implemented, for example, as a steel rectangular solid having a bore 164 formed therethrough. As shown in FIG. 2, the tool itself may be implemented as a striker pin 166 that is generally cylindrical in shape and that has an upper surface 168 that in operation is struck by the impact weight 104. The striker pin 166 also has a lower or working end portion 170 that may serve as a cutting end. Although depicted in FIG. 2 as flat or blunt, the lower end portion 170 may alternatively be conical, pointed, or chisel-shaped, as needed for a particular task. The striker pin 166 has a flat 172 machined into one side thereof. A retaining pin, or shear pin, 174 is passed through the bore 164 in the nose block 162 and intersects the bore 164 so as to pass through the flat 172 machined into the striker pin 166. With the retaining pin 174 in place in the nose block 162, the vertical travel of the striker pin 166 is limited by the upper and lower ends of the flat 172.

The flat 172 that is machined into the striker pin 166 is arranged such that the lower end portion 170 of the striker pin 166 extends below the lower surface of the nose block 162. In addition, the upper surface 168 of the striker pin 166 is located above the upper surface of the nose block 162. The striker pin 166 extends through the lower flange 134 and into the space bounded by the recoil tube 130. At no time will the upper surface 168 of the striker pin 166 be positioned below the upper surface of the nose block 162. The isolator structures 136 are spaced from the lower end of the tubular mast 118 so as to ensure that the lower end 119*b* of the tubular mast 118 is spaced away from the upper surface of the nose block 162 of the tool holding structure 112. Ensuring that space exists between the lower end 119*b* of the tubular mast 118 and the upper surface of the nose block 162 prevents adverse impacts between the lower end 119*b* of the tubular mast 118 and the nose block 162. The space between the lower end 119*b* of the tubular mast 118 and the upper surface of the nose block 162 is bounded by the walls of the recoil tube 130.

In the embodiment shown in FIG. 2, the recoil tube 130 is sized so as to provide clearance between the outer surface of the tubular mast 118 and the inner surface of the recoil tube 130. This clearance prevents binding between the tubular mast 118 and the recoil tube 130 when the impact of the impact weight 104 must be absorbed by the recoil assembly 108.

To further cushion the impact of the impact weight 104 upon the recoil assembly 108, a recoil buffer 176 having a bore sized to accept the upper end portion of the striker pin 166 is located in the space between the upper surface of the nose block 162 and the lower end of the tubular mast 118. In its normal operating position, the lower end portion 170 of the striker pin 166 is placed on a rock to be broken and the upper end portion of the striker pin 166 extends upwardly through the nose block 162 and above the upper surface of the recoil buffer 176. It is intended that the impact weight 104 first strike the upper surface 168 of the striker pin 166, thereby transmitting the majority of the energy of the impact weight 104 to the striker pin 166 for the purpose of breaking the rock positioned below the striker pin 166.

As the striker pin 166 travels downward, the impact weight 104 comes into contact with the upper surface of the recoil buffer 176, which absorbs the forces not imparted to the striker pin 166 by the impact weight 104. The recoil buffer 176 is compressed vertically and simultaneously expands laterally toward the walls of the recoil tube 130. Where a great deal of force is applied to the recoil buffer 176, e.g., when the striker pin 166 is "bottomed out" or "dry fired" when the striker pin 166 is forcefully driven into the retaining pin 174 because there is no rock beneath the striker pin 166 or because the rock has been broken, the lateral expansion of the recoil buffer 176 will bring the peripheral edges of the recoil buffer 176 in contact with the inner walls of the recoil tube 130. Because the outwardly directed forces applied to the inner walls of the recoil tube 130 by the compressed recoil buffer 176 can exceed the strength of the recoil tube 130, the recoil buffer 176 is preferably sized to provide a space between the respective edges of the recoil buffer 176 and the inner walls of the recoil tube 130 to permit the recoil buffer 176 to absorb more force before coming into contact with the walls of the recoil tube 130. Further, because stresses may quickly become concentrated in the corners of a non-circular recoil tube, a chamfer or radius CR is preferably formed at each corner of the recoil buffer 176 to provide a larger space for lateral expansion of the recoil buffer 176 near the corners of a non-circular recoil tube 130. Alternatively, a circular recoil buffer 176 may be used.

The dimensions of the recoil buffer 176 and of the expansion space provided between the periphery of the recoil buffer 176 and the interior walls of the recoil tube 130 are a function of the size of the rock breaking device 100 and of the mass of the impact weight 104 being applied to the striker pin 166. The dimensions of the recoil buffer 176 and of the spaces around the recoil buffer 176 are preferably arranged so as to minimize the stresses applied laterally to the walls of the recoil tube 130.

The recoil buffer 176 is preferably fabricated from an elastomeric or other impact-absorbing material, such as polyurethane or rubber. The elastomeric material should be formulated to be sufficiently stiff and sufficiently resistant to breakdown due to the repetitive impacts by the impact weight 104. While the use of polyurethane or rubber is disclosed herein, those of ordinary skill in the art will appreciate that other materials having suitable spring coefficients and compressibility characteristics may be used instead. In some embodiments, particularly in environments in which the temperature may exceed 180° F., the recoil buffer 176 may incorporate one or more steel springs instead of or in addition to the elastomeric or other impact-absorbing material.

In one embodiment, the recoil buffer 176 is approximately five inches thick and approximately 14¾ inches square. In this embodiment, the recoil tube 130 is implemented as a square recoil tube having an inner diameter of approximately 18½ inches. The impact weight 104 used in this embodiment weighs approximately 4,200 pounds.

Because the lateral forces applied to the walls of the recoil tube 130 can only be minimized and not entirely prevented, reinforcing plates 178 are preferably positioned around the interior of the recoil tube 130 to present a stronger wall to the lateral expansion of the recoil buffer 176. The decreased space between the periphery of the recoil buffer 68 and the inner surface of the recoil tube 130 as defined by the inner surface of the reinforcing plates 178 should be taken into account when sizing the recoil buffer 176. In the embodiment shown in FIG. 2, there is an approximately ⅜ inch gap between the periphery of the recoil buffer 176 and the reinforcing plates 178.

The rock breaking device 100 described herein is used to break up or fracture rocks that are present in quarrying and mining sites. It may also be used to drive piles. In breaking a targeted rock, the rock breaking device 100 is brought into position adjacent the targeted rock by driving the vehicle that mounts the rock breaking device 100 up to the targeted rock. The arms of the vehicle are then used to orient the rock breaking device 100 over the targeted rock so as to position the lower or working end portion 170 of the striker pin 166 on the targeted rock. Once the striker pin 166 has been properly located above the targeted rock, the impact weight 104 is raised by the weight raising mechanism 106 within the guide column 102. The weight raising mechanism 106 then releases the raised impact weight 104, causing the potential energy of the raised impact weight 104 to be converted to kinetic energy that is in turn transmitted through the striker pin 166 to the targeted rock. The striker pin 166 is then either repositioned to either direct another impact to the targeted rock or to put the striker pin 166 into contact with a second rock that is to be broken. The impact weight 104 is again raised and released until the rock or rocks are broken.

If the impact weight 104 is released by the weight raising mechanism 106 without a rock being positioned under the striker pin 166, it is very probable that the impact weight 104 will bottom out the striker pin 166 against the retaining pin 174. This situation is highly undesirable in that such impacts may damage or break the retaining pin 174, thereby necessitating repair to the rock breaking device 100. However, the recoil assembly 108 is arranged and constructed such that the forces imparted to the bottomed out striker pin 166 will be absorbed by the recoil buffer 176 and by the side isolator buffers 142. The recoil buffer 176 and the side isolator buffers 142 prevent damage to the guide column 102 and to the nose block 162. In order to prevent serious damage to the rock breaking device 100, the retaining pin 174 is preferably fabricated from a material that will fail before the nose block 162 or the guide column 102 is damaged or destroyed. In this way, the retaining pin 174 will, as it is being destroyed, absorb additional energy that would otherwise be applied in a destructive manner to the recoil assembly 108 and to the guide column 102.

As described above, considerable stress is placed on the portion of the mast 118 located below the side isolator flange 140, as well as on the side isolator bolts 146, and the side isolator buffers 142 when the striker pin 166, the nose block 162, and the recoil tube 130 are used to position rocks. According to the various embodiments disclosed herein, the side isolator front plates 150 and 151 may bolster the side isolator buffers 142 and prolong their useful lifespan, as well as the useful lifespan of the mast 118 and the side isolator bolts 146 and/or 147. As a result, the dependability and working life of the rock breaking device 100 can be effectively and substantially enhanced.

As demonstrated by the foregoing discussion, various embodiments may provide certain advantages, particularly in the context of breaking rocks. For instance, when the striker pin, the nose block, and the recoil tube are used to position rocks for breaking, a great deal of stress can be placed on the portion of the mast below the side isolator flange, the side isolator bolts, and the side isolator buffers. Adding the plates to the isolator structures increases the life of these parts and makes the rock breaking device more dependable and reliable.

It will be understood by those who practice the embodiments described herein and those skilled in the art that various modifications and improvements may be made without departing from the spirit and scope of the disclosed embodiments. The scope of protection afforded is to be determined solely by the claims and by the breadth of interpretation allowed by law.

What is claimed is:

1. A rock breaking device comprising:

a mast having an upper end portion, a lower end portion and a vertical axis;

a weight slidably disposed to move along the mast in a constrained manner;

a recoil arrangement comprising:

a recoil tube having an upper end portion and a lower end portion operatively connected to the mast so that it can move relative thereto, and so that the upper end portion of the recoil tube is located proximate the lower end portion of the mast and the lower end portion of the recoil tube extends below the lower end portion of the mast, and a panel-shaped upper flange secured to an external surface of the upper end portion of the recoil tube such that a plane defined by the upper flange is generally perpendicular to the vertical axis, the upper flange having an outwardly extending upper surface, an outwardly extending lower surface and a peripheral edge spanning the upper and lower surfaces;

a tool holding structure secured proximate the lower end portion of the recoil tube and configured to receive a tool; and an isolator arrangement comprising an isolator structure secured proximate the lower end portion of the mast and proximate the upper surface of the upper flange, the isolator structure arranged to support the recoil tube, and an isolator plate secured to the isolator structure, with a portion of the isolator plate extending below the isolator structure in a generally cantilever fashion, with said portion spaced outwardly from the recoil tube, with said portion positioned adjacent the peripheral edge of the upper flange and with said portion extending below the lower surface of the upper flange, the peripheral edge of the upper flange being movable relative to said portion as the recoil tube moves relative to the mast, wherein the isolator plate alleviates stresses imparted to the rock breaking device when the recoil arrangement, tool holding structure, and tool are used to position a rock for breaking.

2. The rock breaking device of claim 1, further comprising a plurality of isolator arrangements, each isolator arrangement comprising:

an isolator structure secured proximate the lower end portion of the mast and proximate the upper surface of the upper flange, the isolator structure arranged to support the recoil tube; and an isolator plate secured to the isolator structure, with a portion of the isolator plate extending below the isolator structure in a generally cantilever fashion, with said portion spaced outwardly from the recoil tube, with said portion positioned adjacent the peripheral edge of the upper flange and with said portion extending below the lower surface of the upper flange, wherein the isolator plate is arranged to alleviate stresses imparted to the rock breaking device when the recoil arrangement, tool holding structure, and tool are used to position a rock for breaking.

3. The rock breaking device of claim 2, wherein the plurality of isolator plates substantially encircle the upper flange.

4. The rock breaking device of claim 1, wherein the isolator structure comprises:

a plurality of plate members secured to the mast so that they are generally parallel with the vertical axis of the mast, and so that the plate members are generally parallel with one another; and an isolator flange secured to the mast and to the plate members in a generally perpendicular relationship, with the plate members, the isolator flange, the isolator plate, and a portion of the mast arranged to define an isolator pocket; and an isolator buffer disposed within the isolator pocket.

5. The rock breaking device of claim 1, wherein the isolator plate further comprises a first side extension configured and arranged so that said first side extension is positioned adjacent the peripheral edge of the upper flange, said first side extension extends below the lower surface of the upper flange, and said first side extension is movable with respect to the peripheral edge of the upper flange as the recoil tube moves relative to the mast.

6. The rock breaking device of claim 5, wherein the isolator plate further comprises a second side extension configured and arranged so that said second side extension is positioned adjacent the peripheral edge of the upper flange, said second side extension extends below the lower surface of the upper flange, and said second side extension is movable with respect to the peripheral edge of the upper flange as the recoil tube moves relative to the mast.

7. The rock breaking device of claim 6, wherein the first and second side extensions extend in opposite directions from each other.

8. The rock breaking device of claim 6, wherein the first and second side extensions have a combined width that is substantially equal to the peripheral edge of the upper flange.

9. The rock breaking device of claim 6, wherein the first and second side extensions have a combined width that is greater than a width of the mast.

10. The rock breaking device of claim 1, wherein the isolator structure comprises:

a plurality of plate members secured to a portion of the mast such that they are generally parallel with the vertical axis of the mast, the plate members generally parallel with one another; and a flange having an upper surface and a bottom surface, the flange secured to the mast and to portions of the plate members;

wherein the plate members, the flange, and a portion of the mast define an outwardly and upwardly opening pocket.

11. The rock breaking device of claim 10, wherein a portion of the isolator plate is secured to portions of the plate members and the flange, and wherein the plate members, the flange and the isolator plate further define an upwardly opening pocket.

12. The rock breaking device of claim 1, wherein the recoil tube is resiliently connected to the mast.

13. The rock breaking device of claim 1, wherein the peripheral edge of the upper flange includes an inwardly extending, transverse slot.

14. The rock breaking device of claim 13, wherein the isolator plate has a width that is greater than a width defined by the transverse slot.

* * * * *